US011724788B2

(12) United States Patent
Janhäll

(10) Patent No.: US 11,724,788 B2
(45) Date of Patent: Aug. 15, 2023

(54) ARRANGEMENT FOR A SAILING BOAT FURLING SYSTEM AND A FURLING SYSTEM WITH SUCH AN ARRANGEMENT

(71) Applicant: Seldén Mast AB, Västra Frölunda (SE)

(72) Inventor: Nils Janhäll, Askim (SE)

(73) Assignee: SELDÉN MAST AB, Västra Frölunda (SE)

( * ) Notice: Subject to any disclaimer, the term of this patent is extended or adjusted under 35 U.S.C. 154(b) by 0 days.

(21) Appl. No.: 17/764,299

(22) PCT Filed: Sep. 21, 2020

(86) PCT No.: PCT/SE2020/050880
§ 371 (c)(1),
(2) Date: Mar. 28, 2022

(87) PCT Pub. No.: WO2021/096404
PCT Pub. Date: May 20, 2021

(65) Prior Publication Data

US 2022/0371711 A1 Nov. 24, 2022

(30) Foreign Application Priority Data

Nov. 13, 2019 (SE) ..... 1951310-0

(51) Int. Cl.
*B63H 9/10* (2006.01)

(52) U.S. Cl.
CPC ..... *B63H 9/1028* (2013.01); *B63H 2009/105* (2013.01)

(58) Field of Classification Search
CPC ..... B63H 2009/105; B63H 9/1021; B63H 9/1028; B63H 9/1035; B63H 9/1042
See application file for complete search history.

(56) References Cited

U.S. PATENT DOCUMENTS 4,924,795 A * 5/1990 Ottemann ..... B63H 9/1028 114/106

FOREIGN PATENT DOCUMENTS

| | | |
|---|---|---|
| DE | 21 02 790 | 8/1972 |
| GB | 1 371 994 | 10/1974 |

OTHER PUBLICATIONS

International Search Report issued in parent PCT/SE2020/050880, dated Jan. 25, 2021, pp. 1-2.

(Continued)

*Primary Examiner* — Andrew Polay
(74) *Attorney, Agent, or Firm* — Jeffrey S. Melcher; Melcher Patent Law PLLC

(57) ABSTRACT

The present invention relates to an arrangement (100) for a sailing boat furling system, and for reception of or comprising an outgoing shaft (11) exposed to external torque loads. It comprises a furling drive unit (20) with a gear mechanism (22) and a motor unit (23) connected to an ingoing, motor, shaft (21) and a ratchet mechanism (10) comprising a locking functionality. The ratchet mechanism comprises a housing (17A,17B) and takes up the outgoing shaft (11). The furling drive unit (20) is connectable to ratchet mechanism (10) and is so arranged that the motor unit (23) will be located distant from the outgoing shaft (11), and it further comprises a control unit (30) arranged to control the motor unit (23) driving the ingoing shaft (21). The outgoing shaft can be switched between an engaged mode, in which the outgoing shaft (11), when exposed to external torque loads in a first direction, is allowed to rotate in an opposite, second, direction but prevented from rotating in a said first direction, hence protecting the motor unit and the gear mechanism (22) from external torque loads on the outgoing shaft (11) which are transferred to or taken up by the ratchet mechanism (10), and a disengaged mode in which the outgoing shaft (11) and the ingoing shaft (21) are allowed to (Continued)

rotate in both directions, by controlling, by means of the control unit (30), the movement of the ingoing shaft (21), and thereby, via the ratchet mechanism (10), the outgoing shaft (11) between being in the engaged mode and in the disengaged mode.

17 Claims, 7 Drawing Sheets

(56) References Cited

OTHER PUBLICATIONS

Written Opinion issued in parent PCT/SE2020/050880, dated Jan. 25, 2021, pp. 1-12.

* cited by examiner

ARRANGEMENT FOR A SAILING BOAT FURLING SYSTEM AND A FURLING SYSTEM WITH SUCH AN ARRANGEMENT

TECHNICAL FIELD

The present invention relates to an arrangement for a sailing boat furling system having the features of the first part of claim 1. The invention also relates to a furling or reefing system having the features of the first part of claim 16.

BACKGROUND

Sails that are used on a sailing boat may e.g. comprise the mainsail, spinnaker, jib, headsail, and genoa. The sails are supported by one or more masts, a vertical pole or spar that extends upward from the boat. The mainsail is also supported by a boom attached to the mast to support the bottom part of the mainsail. The sails are attached to lines or wires holding them in place and applying tension to the sails and supporting e.g. the mast. The lines, or wires, are denoted differently depending on location and function or attachment such as headstay, backstay, shrouds, sheets, halyards, etc. The mainsail is easier to control than the other sails since it is attached to the mast and the boom. When not in use, furling sails are furled in.

Wind conditions may require that a sail be used with a reduced area. Reducing the area of the sail is denoted reefing. Reefing in or reefing out to decrease or increase the area of the sail is done depending on e.g. wind conditions. The torque load on the furling system when furling in/out with a non-tensioned, flattering sail is considerably lower than the torque load on a furling system from a partially reefed, tensioned sail subjected to wind loads.

Furling systems generally comprise a gear mechanism and a brake system. Furling in and reefing the mainsail, but also other sails, mean that a considerable torque is created. Many furling systems, here taken to mean furling systems for sailing boats in general, such as furling systems for mainsails, for headsails for gennakers, genoas etc. comprise a motor pack comprising a motor and a gearbox or gear mechanism and a brake unit.

In particular, since the brake in known systems is located furthest down in the system, at the motor, the gear-box and the motor unit have to be over-dimensioned since e.g. the external torque in the outgoing shaft during sailing for example of the main sail can be about several times the maximum torque in the outgoing shaft at roll-in. It is a disadvantage that for example the gear unit and/or the motor unit as well as, in the latter case, the power supply have to be large and space demanding, and over dimensioned.

SUMMARY OF THE INVENTION

It is therefore an object of the present invention to provide a solution to one or more of the above mentioned problems. It is a particular object to provide a solution through which a small and compact gear mechanism can be used. It is particularly an object to provide a solution through which a smaller motor pack, particularly with a lower power consumption, can be used. A particular object is to provide a solution through which there is no need for an over dimensioned motor pack. Still further it is an object to provide a solution through which high, and even uncontrolled external torques in an outgoing shaft can be handled. It is also an object to provide a solution through which a small and compact motor unit and gear-box can be used in a furling system.

Other objects are to provide an arrangement and a furling system respectively which is easy to install, demands less space than hitherto known solutions, which furthermore is easy to use and control, and flexible as far as installation is concerned, and which in addition thereto is cheap and can be installed and run at a low cost. It is also an object to provide an arrangement a initially referred to which is reliable and safe, also in situations with high external torque loads, or with uncontrolled, sudden external torque loads.

A particular object is to provide a flexible concept and suggest an arrangement that can be used for different types of sails and for different purposes regarding furling in/out sails of different types, for reefing in/reefing out etc.

Therefore an arrangement as initially referred to is provided which comprises the characteristic features of the characterizing part of claim 1.

Therefore also a furling system as initially referred to is provided which has the characterizing features of claim 16.

Advantageous embodiments are given by the respective appended dependent claims.

BRIEF DESCRIPTION OF THE DRAWINGS

The invention will in the following be further described, in a non-limiting manner, and with reference to the accompanying drawings, in which.

DETAILED DESCRIPTION

Figure 1:
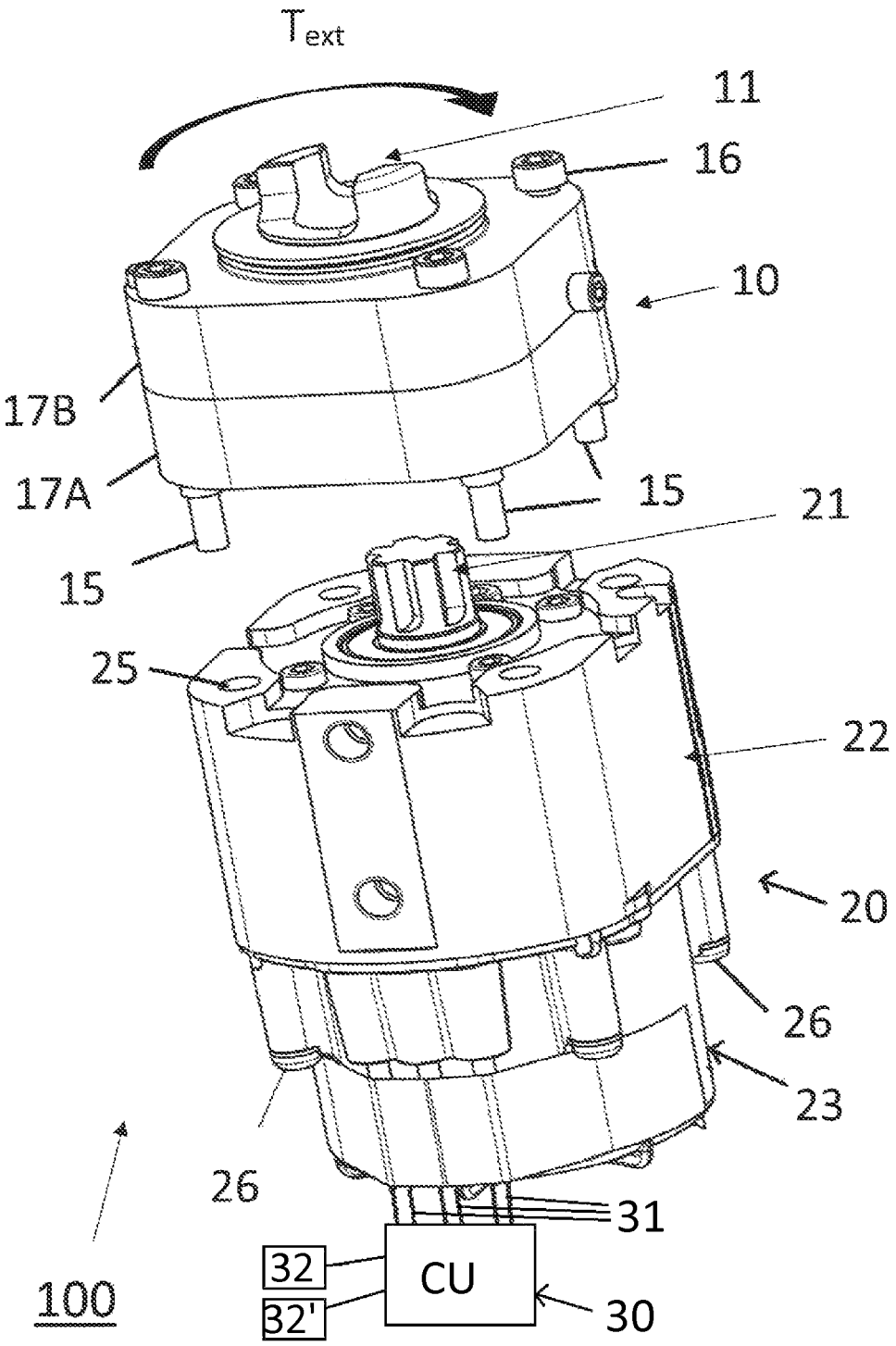
FIG. 1 schematically illustrates an arrangement for a furling system comprising a motor controlled ratchet mechanism arrangement according to an embodiment of the invention.

FIG. 1 shows an arrangement 100 for use in a furling system according to the invention. It comprises a ratchet mechanism arrangement 10, a furling drive unit 20 and an electronic control unit CU 30. The control unit 30 is connected to or comprises activation means 32,32' for activating and controlling a change from an engaged mode to a disengaged mode, and for activating and controlling a change from the disengaged mode to the engaged mode. The activation means may comprise a first button 32 which e.g. when pressed by a user, or when receiving a signal, activates a change from the engaged mode to the disengaged mode, and a second button 32' which e.g. when pressed by a user, or when receiving a signal, activates a change from the disengaged mode to the engaged mode. The activation means may also comprise any other means, remote control means may be provided, they may comprise a common activation means etc. that can be activated for two different functions etc. The changing from one mode to another will be more thoroughly describe below.

The ratchet mechanism arrangement 10 comprises a locking unit and is arranged in a ratchet mechanism housing comprising a ratchet mechanism housing upper part 17B connected to, or taking up, an outgoing shaft 11 and a ratchet mechanism housing lower part 17A. The ratchet mechanism housing lower and upper parts 17A,17B are interconnected by means of screws 16 and bushings 15.

The furling drive unit 20 comprises a gearbox assembly 22 and a motor unit 23. The ratchet mechanism arrangement 10 is connectable to, here, the upper portion of the furling drive unit 20 which comprises holes 25 for taking up the screws 15 or bushings 16. In FIG. 1 connection elements 26 are schematically illustrated for assembly of the motor unit 23 and the gearbox assembly 22. The motor unit 23 is via cables or wires 31 connected to an electronic control unit 30 for controlling the motor unit 23 through which switching between an engaged mode, in the following also called a ratchet mode, and a disengaged mode, in the following also called a free mode, and locking etc. according to the inventive concept is achieved. The controlling functionality of the control unit will be further described below.

In the shown embodiment an external holding torque $T_{ext}$ is acting in an external torque direction, here clockwise, on the outgoing shaft 11.

By a controlled movement of the motor unit shaft 21, the outgoing shaft 11 can be shifted from being in a ratchet mode to a free mode and vice versa as will be further described with reference in particular to FIG. 2 and FIG. 3 below.

The motor unit shaft 21 can take a maximum motor unit torque $TM_{max}$.

According to the invention, the motor unit 23 is arranged to control (via the control unit 30) the outgoing shaft 11 such that it can be subjected to a higher static holding torque load (in one direction) than the motor unit 23 can take by means of the ratchet mechanism 10.

In the illustrated embodiment the first direction is clockwise, whereas the second direction is anti-clockwise. It should be clear that the inventive concept also is applicable for the reversed situation, i.e. when a first direction is anti-clockwise and the second is clockwise.

The outgoing shaft 11 can take a maximum holding torque $TO_{hold,max}$. It should be clear that the arrangement according to the present invention can have a mirrored design to work in the opposite direction, i.e. with an external torque acting in an anti-clockwise direction.

Figure 1A:
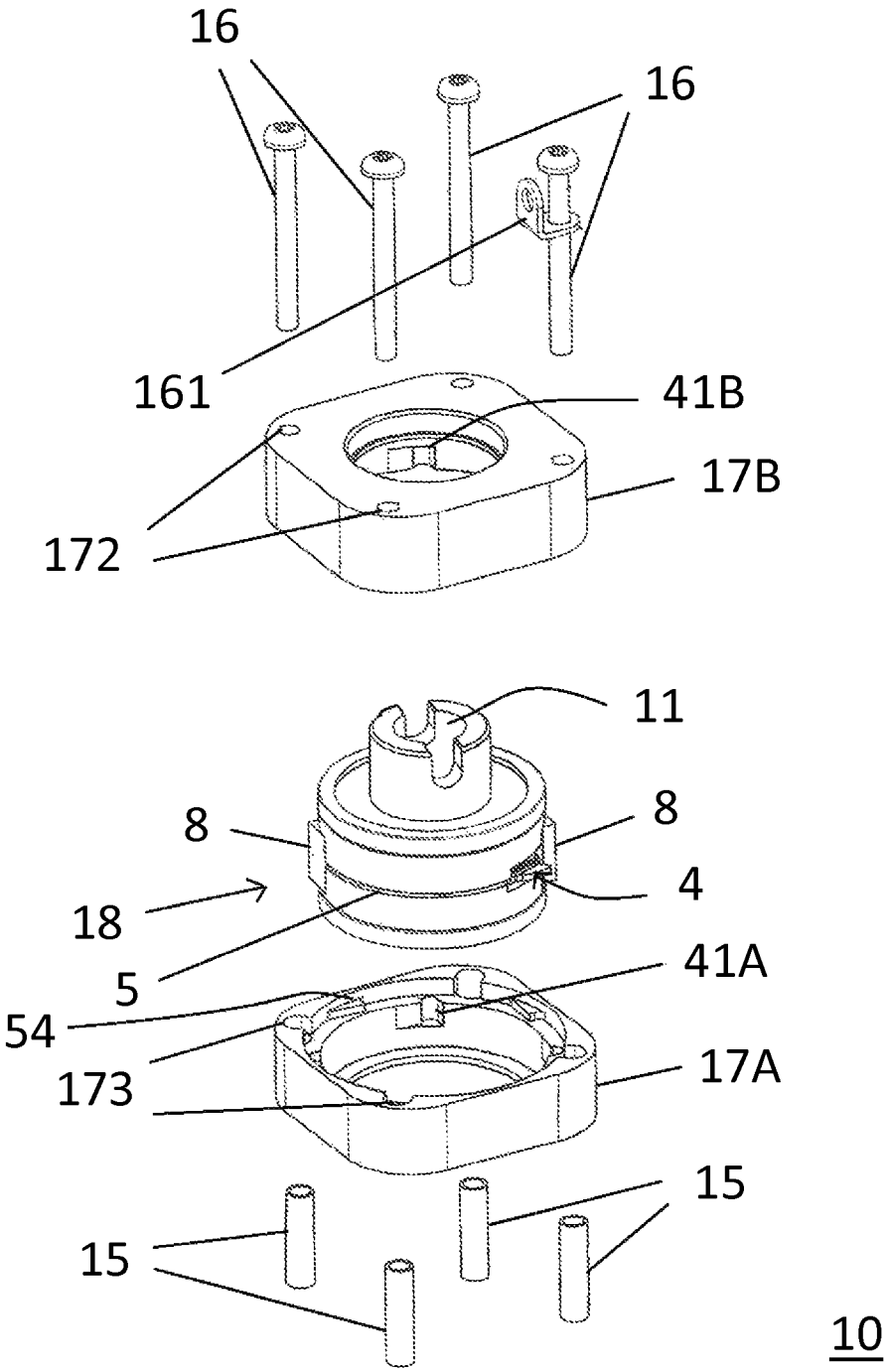
FIG. 1A is an exploded view of the motor controlled ratchet mechanism arrangement shown in FIG. 1.
Figure 1B:
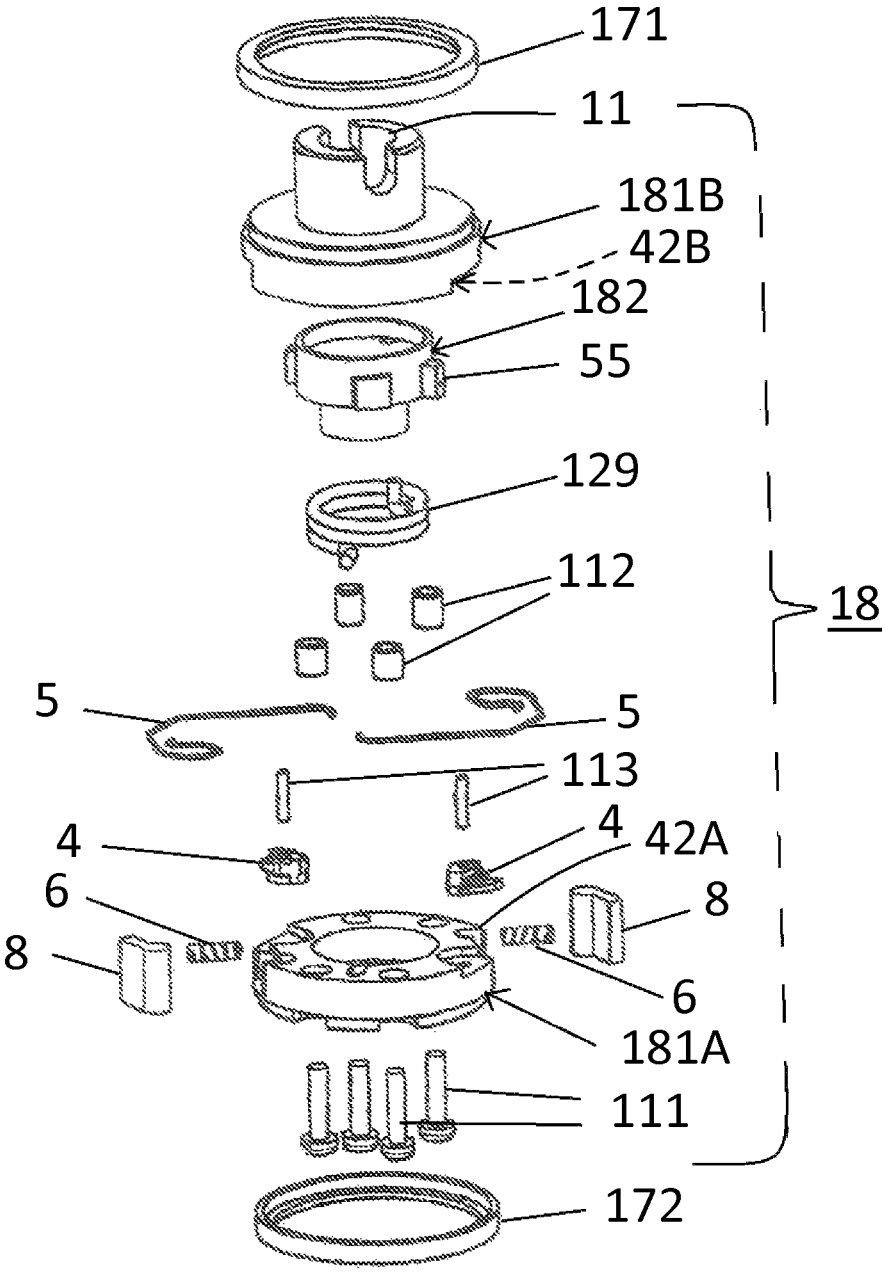
FIG. 1B is an exploded view of the ratchet hub of the ratchet mechanism arrangement of FIG. 1.

FIG. 1A shows an exploded view of the ratchet mechanism arrangement 10 illustrating ratchet mechanism housing lower and upper parts 17A,17B adapted to house the ratchet hub 18 (see also FIG. 1B). The ratchet mechanism housing lower and upper parts 17A,17B are interconnected by means of screws 16 and bushings 15 and openings 173 in the ratchet mechanism housing lower parts 17A. One of the screws 16 is here provided with a lift strap 161 (optional).

The ratchet mechanism housing 17A,17B comprises four (here) pawl locking seats, each of which formed by a lower pawl locking seat part 41A in the ratchet mechanism housing lower part 17A and an upper pawl locking seat part 41B in the ratchet mechanism housing upper part 17B. The purpose of the pawl locking seats is to take up ratchet pawls 8 of the ratchet hub 18 in an engaged, ratchet, mode. In a disengaged, free mode the ratchet pawls are prevented from being taken up in the pawl locking seats as will be further described below.

The ratchet mechanism housing lower part 17A further comprises four equidistantly disposed ratchet control arm engagement cams 54 which are provided on a circumferential edge on top of an inner substantially cylindrical wall in which the lower pawl locking seat parts 41A are located, such that each ratchet control arm engagement cam 54 is located above (in a direction towards the outgoing shaft 11), in a level at the upper end of the lower pawl locking seat part 41A and between two equidistantly and circumferentially disposed lower pawl locking seat parts 41A. The ratchet control arm engagement cams 54 control two spring control arms 4 of the ratchet hub 18.

The ratchet hub 18 is taken up within the ratchet mechanism housing lower and upper parts 17A,17B resting on a lower circumferential edge protruding slightly inwards from the inner wall of the ratchet mechanism housing lower part 17A. The ratchet hub 18 comprises two ratchet pawls 8,8 disposed and protruding on opposite outer cylindrical side walls of the ratchet hub 18 and two spring control arms 4,4 as will be more thoroughly illustrated in FIG. 1B.

FIG. 1B is a schematic exploded view of the, here, electrically controlled ratchet hub 18 comprising an upper hub unit 181B by means of screws 111 and bushings 112 connected or secured to a lower hub unit 181A. Preferably a torque position spring 129 is disposed between the upper and the lower hub units 181B,181A to assure that a minimum torque to allow engagement/disengagement of the ratchet pawls 8.

Within a lower peripheral substantially cylindrical wall of the upper hub unit 181B an ingoing shaft socket 182 is provided for taking up the ingoing, motor, shaft 21. Two ratchet hub control arm disengagement cams 55,55 are disposed on and protruding in opposite directions from the outer cylindrical wall of the ingoing shaft socket 182. The ingoing shaft socket 182 is controlled by the motor of the motor unit 23.

In FIG. 1B also the upper bushing 171 and a lower flange bushing 172 are shown via which the electrically controlled ratchet hub 18 is taken up within ratchet mechanism housing lower and upper parts 17A,17B.

External torques to which outgoing shaft 11 is exposed will be taken up by the ratchet mechanism arrangement 10 housing via ratchet pawls 8,8, which can be taken up in or released from pawl locking seats 41A,41B in the ratchet mechanism housing lower and upper parts 17A,17B (FIG. 1A), allowing transfer between an engaged, ratchet, mode and a disengaged, free, mode as will be further described below in particular with reference to FIG. 2 and FIG. 3. The ratchet pawls 8,8 are actuated upon via respective coil springs 6,6 and pawl control spring(s) 5(,5) via spring control arms 4,4 connected to lower hub unit 181A by means of pins 113.

Two oppositely directed outwardly facing pawl bearing seats are formed by a respective lower and an upper pawl bearing seat part 42A,42B in the outer wall of the respective lower and upper hub part 181A,181B.

The outgoing shaft 11 can as referred to above be switched between a ratchet mode and free mode.

Figure 2:
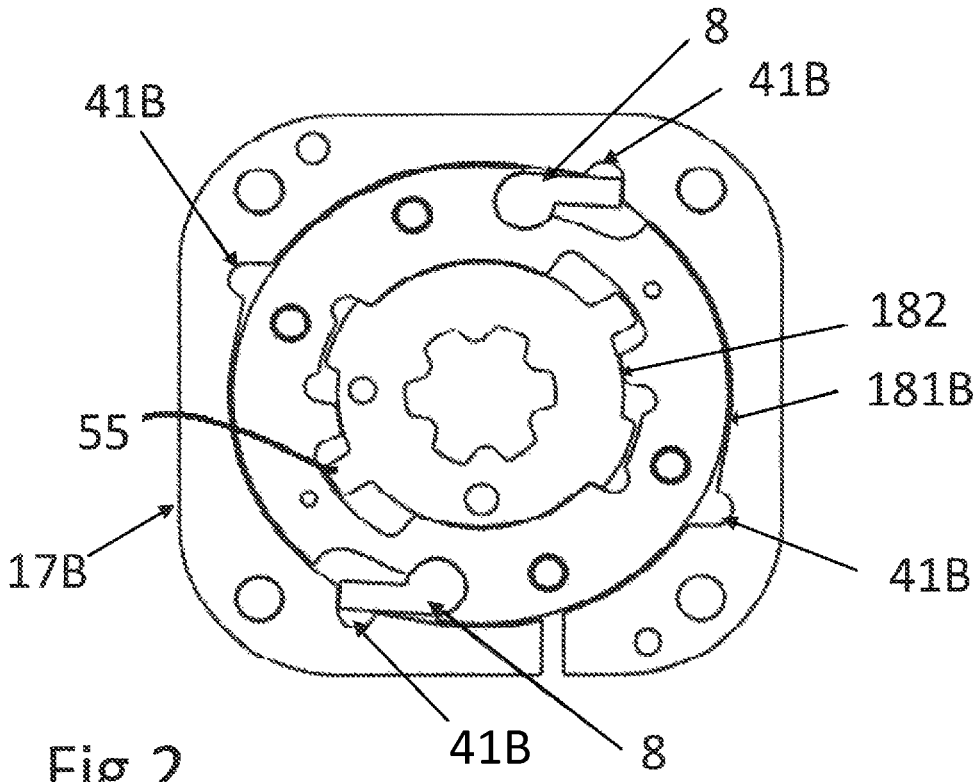
FIG. 2 is a transversal cross-sectional view taken through the ratchet mechanism upper housing part slightly above the ratchet mechanism lower part housing illustrating the outgoing shaft in a ratchet mode.

FIG. 2 is a schematic cross-sectional view through the ratchet mechanism housing upper part 17B just above the ratchet mechanism housing lower part 17A of the ratchet mechanism arrangement 100 when the outgoing shaft 11 is in an engaged, ratchet, mode. The ratchet pawls 8,8 are in an engaged mode, here spring loaded anti-clockwise by means of coil springs 6,6 pushing the ratchet pawls 8,8 to turn anti-clockwise as more clearly shown in FIG. 4, and hence taken up in two of the four pawl locking seats (here only the upper parts 41B of the pawl locking seats being shown; lower parts 41A are shown in FIG. 1A) in the ratchet mechanism housing upper part 17B of the motor controlled ratchet mechanism 10 housing.

Thus, external clockwise torque loads on the outgoing shaft 11 are transferred to the ratchet mechanism 10 (housing) via the ratchet pawls 8,8 and the pawl locking seats, hence preventing the outgoing shaft 11 from rotating clockwise and protecting the motor 23 and the gearbox 22 from external torque loads. Thus, the demands on the motor unit (and power supply) and the gearbox are considerably reduced and therefore smaller motors and gearboxes can be used.

The outgoing shaft can still rotate anti-clockwise by running the inner or motor unit shaft 21 anti-clockwise or by external anti-clockwise torque loads.

The inventive concept is applicable irrespectively of type of gear or gear box, there being no particular requirements thereon. The motor may e.g. be a step motor, a brushless DC motor and preferably electrically controllable by means of an electric control unit CU 30 (cf. FIG. 1).

It should be clear, however, that the inventive concept also is applicable for other types of motors, or even for manual control and operation.

Figure 3:
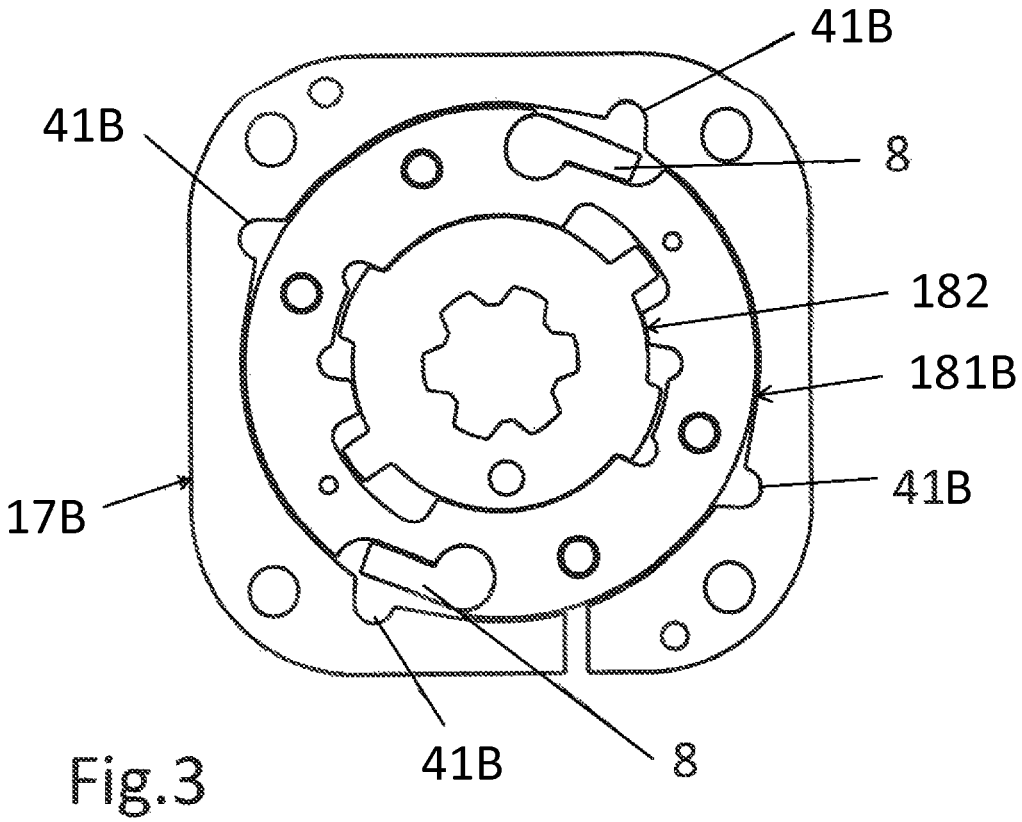
FIG. 3 is a transversal cross-sectional view taken through the ratchet mechanism upper housing part slightly above the ratchet mechanism lower part housing illustrating the outgoing shaft in a free mode.

FIG. 3 is a schematic cross-sectional view through the ratchet mechanism housing upper part 17B just above the ratchet mechanism housing lower part 17A of the ratchet mechanism arrangement 100 when the outgoing shaft 11 is in a disengaged, free, mode. The ratchet pawls 8,8 are now in a disengaged mode, i.e. disengaged from the pawl locking seats (here only the upper parts 41B of the pawl locking seats being shown; lower parts 41A are shown in FIG. 1A) in the ratchet mechanism housing upper part 17B of the motor controlled ratchet mechanism 10 housing The disengagement of the ratchet pawls 8,8 is achieved as follows: the ratchet pawls 8,8 are spring loaded clockwise by means of the force of a respective pawl control springs 5 (or a common pawl control spring arrangement) and the force of the, or each, pawl control spring 5 exceeds the force of a respective coil spring 6 (see FIG. 1B) acting on the same ratchet pawl 8, hence allowing both the outgoing shaft 11 and the motor shaft 21 to rotate in both directions. (cf. FIG. 5).

Figure 4:
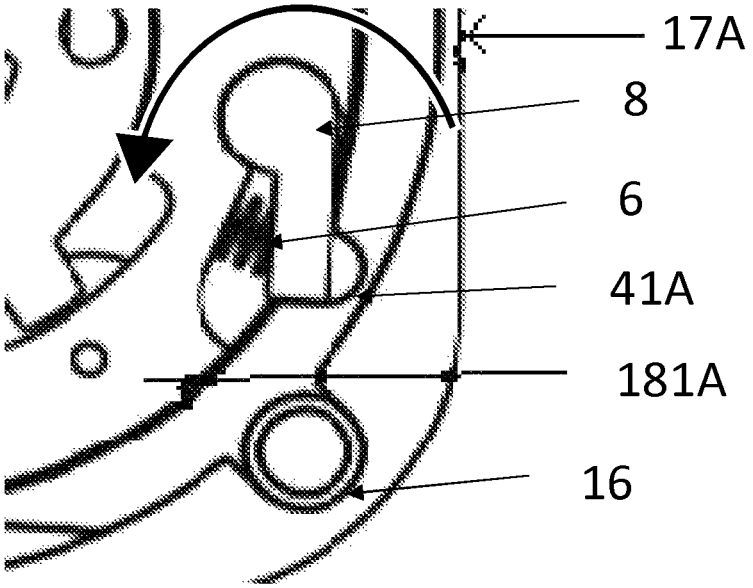
FIG. 4 is a view taken schematically illustrating a ratchet pawl of the ratchet mechanism arrangement in an engaged mode.

FIG. 4 is a schematic enlarged detail section illustrating a ratchet pawl 8 when it is in an engaged mode, i.e. when engaged in a pawl locking seat of the outgoing shaft is in ratchet mode as described with reference to FIG. 2, but showing a view through the lower ratchet hub 181A in the ratchet mechanism housing lower part 17A. In FIG. 4 only the lower part of the pawl locking seat 41A is shown. The coil spring 6 pushes on the ratchet pawl 8 as can be seen in FIG. 4. Elements already discussed with reference to preceding drawings bear the same reference numerals and will not be further discussed here.

Figure 5:
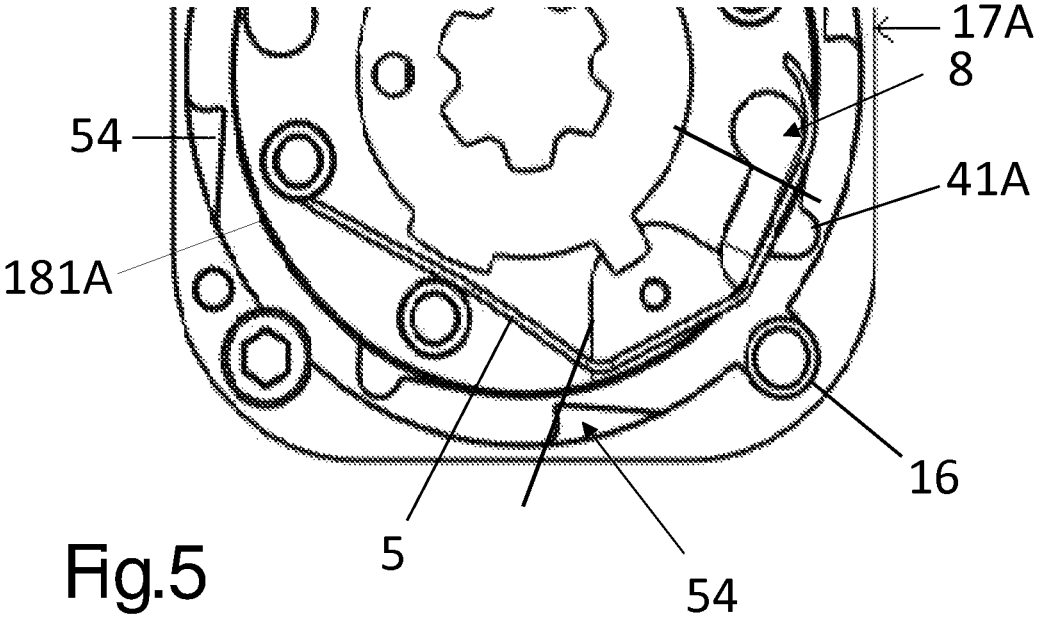
FIG. 5 is a view taken schematically illustrating a ratchet paw of the ratchet mechanism arrangement in a disengaged mode.

FIG. 5 is a schematic enlarged section illustrating a ratchet pawl 8 when it is in a disengaged mode, i.e. when released from a pawl locking seat and the outgoing shaft 11 is in free mode as described with reference to FIG. 3, but showing a view through the lower ratchet hub 181A in the ratchet mechanism housing lower part 17A. In FIG. 5 only the lower part of the pawl locking seat 41A is shown. The pawl control spring 5, e.g. a customary wire spring, then pushes the ratchet pawl 8 (only one shown in FIG. 4) to turn clockwise, and the force from the pawl control spring 5 in a disengaged mode exceeds the force of the coil spring 6. Thus, in disengaged, free, mode, the ratchet pawls 8 are disengaged from the pawl locking seats 41 allowing the outgoing shaft 11 and the motor shaft 21 to turn or rotate clockwise.

The ratchet pawls 8,8 are hence spring loaded by the coil springs 6,6 and by the pawl control springs 5,5 which are controlled by spring control arms 4,4 which can be set or arranged to take two different positions, either activating (or engaging) the ratchet pawls 8,8, or disengaging them via the pawl control springs 5,5. In FIG. 5 two of the ratchet housing control arm engagement cams 54,54, the functioning of which will be further explained with reference to FIG. 9 below.

Elements already discussed with reference to preceding drawings bear the same reference numerals and will not be further discussed here.

Figure 6:
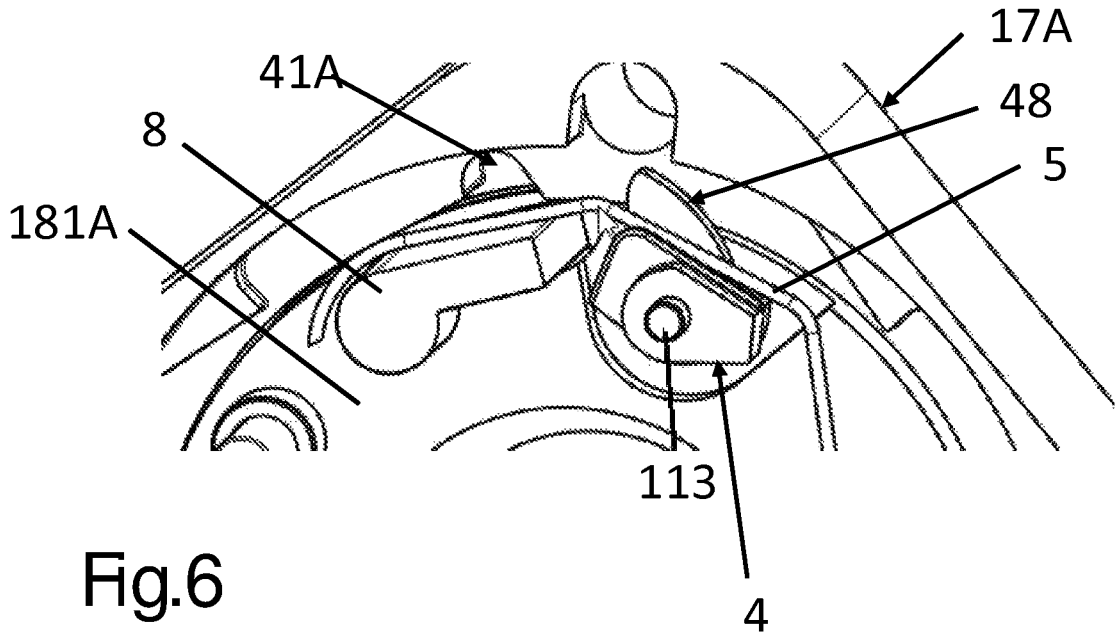
FIG. 6 is a schematic detail view showing a pawl control spring controlled by a spring control arm.

FIG. 6 is an enlarged view of a section showing a part of the lower hub part 181 within the ratchet mechanism housing lower part 17A in a free rotation mode. It is illustrated how the position of a pawl control spring 5 is controlled by a spring control arm 4. Elements already discussed with reference to preceding drawings bear the same reference numerals and will not be further discussed here. The spring control arm 4 is rotatably secured with a pin 113 fitted to the lower hub part 181A close to the rotatably secured ratchet pawl 8. The spring control arm 4 comprises two spring seats, a lower spring seat 45 and an upper spring seat 46 for the pawl control spring 5 more clearly illustrated in FIG. 7. By rotating the spring control arm 4, the pawl control spring 5 is lifted or lowered, in turn controlling the position of the ratchet pawl 8.

Figure 7:
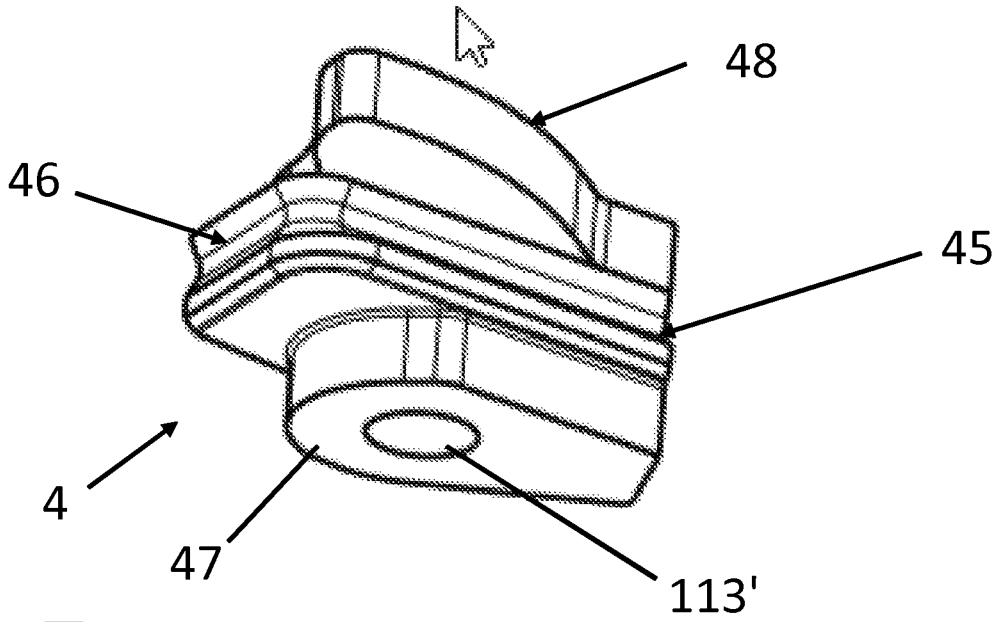
FIG. 7 is a schematic detail view of the spring control arm shown in FIG. 6 illustrating an upper and a lower spring seat.

FIG. 7 is a view of the spring control arm 4 illustrating the lower spring seat 45 and the upper spring seat 46 in which the pawl control spring will be taken up depending on rotation position of the spring control arm. The spring control arm comprises a first, lower, control cam arm 47 and a second, upper, control cam arm 48 between which the lower and upper spring seats 45,46 are disposed. The spring control arm 4 is as referred to in FIG. 6 rotatably secured to the lower hub part 181A; in FIG. 7 the screw hole 113' for taking up a mounting screw or pin 113.

Figure 8:
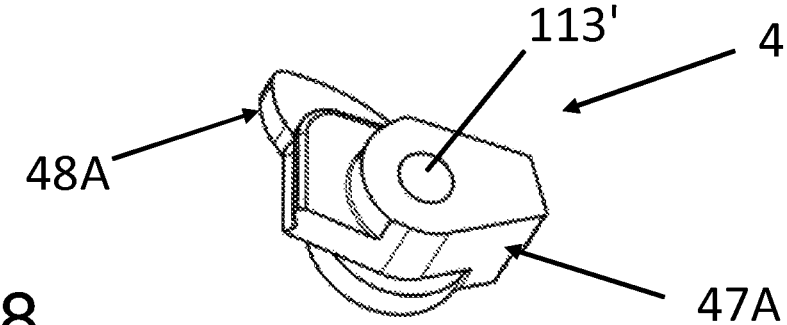
FIG. 8 is a schematic detail view of the spring control arm shown in FIG. 6 illustrating a first and a second control cam.

FIG. 8 is another view of the spring control cam arm 4 illustrating the two control cam arms comprising the first, lower, control cam arm having a first control cam 47A, and the second, upper, control cam arm 48 having a second control cam 48A for depending on rotating state being engaged by a ratchet housing control arm engagement cam 54.

By the first and second control cams 47A,48A the position of the spring control cam arm 4 is controlled via the motor unit shaft 11 and the ratchet control mechanism 10.

For switching the outgoing shaft 11 from disengaged, free, mode to engaged, ratchet, mode, the outgoing shaft 11 is moved in relation to the housing of the ratchet control mechanism arrangement 10.

For switching the outgoing shaft 11 from ratchet mode to free mode, the motor shaft 21 is moved in relation to outgoing shaft 11.

Figure 9:
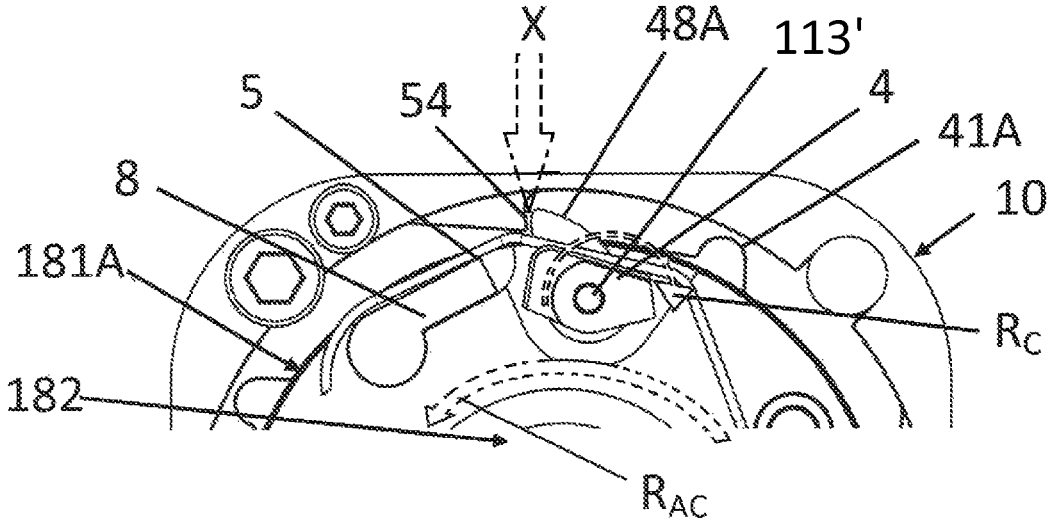
FIG. 9 is a schematic cross-sectional view through the lower part ratchet mechanism housing in the procedure of switching from free to ratchet mode.

In FIG. 9 is schematically illustrated how the outgoing shaft 11 is switched from free mode to ratchet mode. As the outgoing shaft 11 is turned anti-clockwise (indicated through arrow $R_{AC}$ in FIG. 9) inside the ratchet control mechanism 10 housing in free mode, a ratchet housing control arm engagement cam 54 in the ratchet control mechanism 10 housing gets in contact with the second control cam 48A of the spring control arm 4, (arrow X) and makes it rotate approximately 90° (indicated through arrow $R_C$ in FIG. 9), and thereby lifts the pawl control spring 5 from the ratchet pawl 8, hence activating the ratchet mode. In FIG. 9 the ingoing shaft socket is schematically indicated. Other elements already discussed with reference to preceding drawings bear the same reference numerals and will not be further discussed here.

Figure 10:
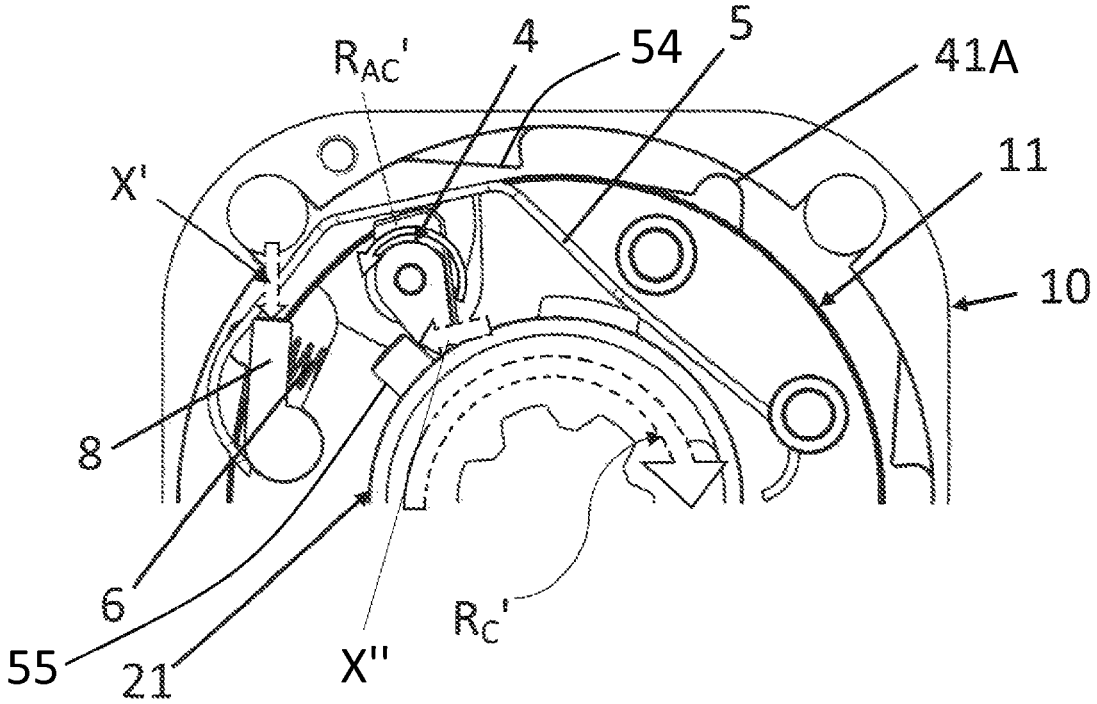
FIG. 10 is a schematic cross-sectional view through the lower part ratchet mechanism housing in the procedure of switching from ratchet to free mode.

FIG. 10 schematically illustrates the procedure when the outgoing shaft 11 is switched from ratchet mode to free mode. When in ratchet mode and the motor unit shaft 21 is turned clockwise (indicated through arrow $R_C'$ in FIG. 10), the ratchet pawls 8 will prevent the outgoing shaft 11 from rotating. A rotational movement between the motor unit shaft 21 and the outgoing shaft 11 will make the spring control arms 4 rotate (only one shown in FIG. 10). A ratchet hub control arm disengagement cam 55 on ingoing shaft socket 182 of the ratchet hub 18 will engage with the spring control cam 48A (arrow X") and make the spring control arm 4 turn (arrow $R_{AC'}$), and the pawl control spring 5 will act on the ratchet pawl 8 (arrow X') which will now push the ratchet pawl 8 inwards. However, as the ratchet pawl 8 may be locked in position by friction (between the end of the ratchet pawl 8 and pawl locking seats 41A,41B) at high external torque loads on the outgoing shaft 11, the motor unit shaft 21 must now make a small anticlockwise rotation to take the load off the ratchet pawl 8 allowing it to disengage by the load of the pawl control spring 5. It should be clear that although throughout the detail view drawings when only one element, e.g. ratchet pawl etc. is illustrated and shown, the same is valid also for the other corresponding similar elements.

It should be noted that the holding torque may not exceed the motor unit maximum torque at this operation, otherwise the disengagement of the ratchet pawl 8 will not work.

A change from engaged mode to disengaged or free mode can be activated by means of activating a first disengagement activation means, e.g. comprising a disengagement activation button 32 connected to the control unit 30. When the first, disengagement means 32 are activated, the control unit 30 control the motor unit 23 of the drive unit 20 to run in the first direction until the torque increases, and the ratchet pawls 8,8 will be locked or engaged in the respective pawl locking seats 41A,41B giving a zero angle position defining a starting angular position. With the ratchet pawls 8,8 locked in the respective pawl locking seats 41A,41B, the control unit 30 will run the motor unit 23 or the drive unit 20 with an increased torque to overcome a bias torque produced by the torque position spring 129 arranged in the ratchet hub 18 between the 182 and the lower hub part 181A (see FIG. 1B), and control the motor 20 to make a first number (N) of revolutions starting from the zero angle position in the first direction to rotate the ingoing shaft socket 182 to move the spring control arms 4,4 into a disengaged mode position, disengaged from the ratchet hub control arm disengagement cam 55. N may e.g. be a number between 3 and 7, more particularly e.g. 5, although the inventive concept is not limited thereto. N may be somewhat more or less. The control unit 30 will then run the motor 23 in the second direction a second, low, number (N') of revolutions until the ratchet pawls 8,8 are lifted from the respective pawl locking seats 41A,41B. N may e.g. be a number between 3 and 7, more particularly e.g. 5, although the inventive concept is not limited thereto. N may be somewhat more or less.

The control unit 30 then controls the motor of the motor unit 23 to make a third number (N") of revolutions, N" e.g. between 30 and 70, e.g. about 50, with a low speed in the first direction to assure that a correctly performed unlocking or disengagement of the ratchet pawls 8,8 has been achieved. It should be clear that the inventive concept is not limited to any particular number of revolutions N", but it should be as many as required to make sure that disengagement has been achieved.

The control unit (30) then controls the motor of the motor unit 23 to run in the first direction until the first disengagement activation means, e.g. the disengagement activation button 32, is deactivated.

A change from disengaged, free, mode to engaged mode can be activated by means of activating a second, engagement, activation means, e.g. comprising an engagement activation button 32' connected to the control unit 30. When the second, engagement, activation means 32' are activated, the control unit will run the motor unit 23 or the drive unit 20 in the second direction, the ratchet housing control arm disengagement cam 54 moving the spring control arms 4,4 into an engagement mode position.

The control unit (30) will then run the motor of the motor unit 23 in the second direction until the second, engagement, activation means, e.g. the engagement activation button 32', is deactivated. In alternative embodiments (not shown) the locking, ratcheting elements may be arranged in an inverted manner such that the ratchet pawls are instead arranged in, or rotatably secured to, the housing etc.

Through the use of a ratchet mechanism arrangement 100 according to the invention a small motor pack (comprising motor, gearbox and power supply) can be used to control an outgoing shaft 11 that can be subjected to higher static torque loads than the motor pack can handle.

It is an advantage that, for example for furling systems, the arrangement according to the invention can be used and e.g. replace a worm gear mechanism which only has an efficiency of about 30%, and requires an oversized motor and oversized power supply.

It should be clear that the invention is not limited to the explicitly described embodiments but that it can be varied in a number ways within the scope of the appended claims. The arrangement is particularly intended for use on a boat, particularly a leisure sailing boat, in applications where a maximum expected holding torque higher than a motor unit operation torque, such as in furling systems for mainsails, furling systems for headsails (Jibs and Genoas), for Cod 0 and gennaker furling systems, but also for other systems where similar problems may arise, also in other applications than for furling systems.

It should also be clear that the content of described embodiments freely can be varied and combined.

The invention claimed is:

1. An arrangement for a sailing boat furling system arranged for reception of or comprising an outgoing shaft exposed to external torque loads, the arrangement comprising:

a furling drive unit comprising a gear mechanism and a motor unit connected to an ingoing shaft or motor shaft;

a ratchet mechanism comprising a locking functionality, the ratchet mechanism comprises a ratchet mechanism housing and is arranged for taking up the outgoing shaft, the furling drive unit is connectable to the ratchet mechanism and is so arranged that the motor unit is located distant from the outgoing shaft; and a control unit for control of the motor unit driving the ingoing shaft, wherein the outgoing shaft can be switched between an engaged mode, in which the outgoing shaft, when exposed to external torque loads in a first direction, is allowed to rotate in an opposite, second, direction but prevented from rotating in a said first direction, hence protecting the motor unit and the gear mechanism from external torque loads in said engaged mode, external torque loads on the outgoing shaft being transferred to or taken up by the ratchet mechanism, and a disengaged mode, in which the outgoing shaft and the ingoing shaft, or the motor shaft, are allowed to rotate in both directions, by controlling, by means of the control unit, the movement of the ingoing shaft, and thereby, via the ratchet mechanism, the outgoing shaft, between being in the engaged mode and in the disengaged mode, and wherein the ratchet mechanism further comprises a ratchet hub which is rotatable within the ratchet mechanism housing, said ratchet hub being provided with rotatably stored ratchet pawls, each ratchet pawl being spring loaded by means of springs, that the ratchet mechanism housing comprises pawl locking seats in a substantially cylindrical inner wall thereof, and in that in the engaged mode, the ratchet pawls are taken up in said pawl locking seats, whereas in the disengaged mode the ratchet pawls are released from said pawl locking seats, hence allowing transfer between the engaged mode and the disengaged mode by controlling the direction and the speed of rotation of the ingoing shaft by the control unit controlling the motor unit, and in that external torques to which outgoing shaft is exposed are taken up by the ratchet mechanism housing via said ratchet pawls.

2. The arrangement according to claim 1, wherein the springs loading each ratchet pawl of the ratchet hub comprises a respective coil spring acting on the ratchet pawl to turn or rotate in the second direction, and a respective pawl control spring acting or pushing the ratchet pawl to turn in the first direction, that in an engaged ratchet pawl mode, each ratchet pawl of the ratchet hub is spring loaded via the respective coil spring such that a ratchet pawl end portion of each ratchet pawl will be taken up in a respective pawl locking seat, the force of the coil spring exceeding the force of the respective pawl control spring or the pawl control spring being deactivated or disengaged in a first state, whereas in a disengaged ratchet pawl mode, the force exerted by the respective pawl control spring in a second state of each ratchet pawl exceeds the force of the respective coil spring, the ratchet pawl hence being released from the pawl locking seat.

3. The arrangement according to claim 2, wherein the ratchet hub, for each ratchet pawl, comprises a rotatably stored spring control arm arranged to control the position or state of the respective pawl control spring, such that depending on rotation position of the spring control arm, the respective pawl control spring will be in a first state or position or in a second state or position.

4. The arrangement according to claim 3, wherein the spring control arm comprises a first, lower, control cam arm with a first control cam and a second, upper, control cam arm with a second control cam used for controlling a position of the spring control arm via the motor shaft and the ratchet mechanism.

5. The arrangement according to claim 4, wherein the ratchet mechanism housing comprises a ratchet mechanism housing lower part and a ratchet mechanism housing upper part which are interconnected and arranged to take up the ratchet hub.

6. The arrangement according to claim 5, wherein the ratchet mechanism housing lower part on an inner wall thereof, and for each ratchet pawl is provided with a respective ratchet housing control arm engagement cam or controlling the position of the spring control arm.

7. The arrangement according to claim 5, wherein the ratchet hub comprises a lower hub unit and an upper hub unit which are interconnectable, the upper hub unit being adapted to take up an upper part of an ingoing shaft socket for the ingoing shaft.

8. The arrangement according to claim 7, wherein the ingoing shaft socket of the ratchet hub, for each ratchet pawl, is provided with an outwardly protruding ratchet hub control arm disengagement cam for controlling disengagement of the spring control arm.

9. The arrangement according to claim 8, wherein the ratchet housing control arm engagement cam is adapted to, when the outgoing shaft moves in the second direction, within the ratchet mechanism housing in disengaged, free, mode, engage, get in contact with, the spring control arm and rotate the spring control arm approximately 90° in the first direction, and thereby lift the pawl control spring from the ratchet pawl, hence activating the engaged mode.

10. The arrangement according to claim 8, wherein in the engaged mode, the ratchet pawls are taken up in the respective pawl locking seats, and prevent the outgoing shaft from rotating when rotated in the first direction, and in that, for switching from the engaged mode to the disengaged or free mode, wherein a rotational movement between the ingoing shaft and the outgoing shaft provided by means of the control by the control unit will make the spring control arms rotate, bringing the ingoing shaft disengagement cams into engagement with the spring control arms and making the ingoing shaft disengagement cams turn, allowing the pawl control springs to act on the ratchet pawls such that each ratchet pawl outer end will be disengaged from a respective pawl locking seat.

11. An arrangement for a sailing boat furling system arranged for reception of or comprising an outgoing shaft exposed to external torque loads, the arrangement comprising:

a furling drive unit comprising a gear mechanism and a motor unit connected to an ingoing shaft or motor shaft;

a ratchet mechanism comprising a locking functionality, the ratchet mechanism comprises a ratchet mechanism housing and is arranged for taking up the outgoing shaft, the furling drive unit is connectable to the ratchet mechanism and is so arranged that the motor unit is located distant from the outgoing shaft; and a control unit for control of the motor unit driving the ingoing shaft, wherein the outgoing shaft can be switched between an engaged mode, in which the outgoing shaft, when exposed to external torque loads in a first direction, is allowed to rotate in an opposite, second, direction but prevented from rotating in a said first direction, hence protecting the motor unit and the gear mechanism from external torque loads in said engaged mode, external torque loads on the outgoing shaft being transferred to or taken up by the ratchet mechanism, and a disengaged mode, in which the outgoing shaft and the ingoing shaft, or the motor shaft, are allowed to rotate in both directions, by controlling, by means of the control unit, the movement of the ingoing shaft, and thereby, via the ratchet mechanism, the outgoing shaft, between being in the engaged mode and in the disengaged mode, wherein the control unit comprises or is connected to activation means for activating and controlling the drive unit such that a change from the engaged mode to the disengaged mode will be performed, and for activating and controlling the drive unit or the motor unit to change from the disengaged mode to the engaged mode, and wherein the ratchet hub, for each ratchet pawl, comprises a rotatably stored spring control arm arranged to control the position or state of the pawl control spring, such that depending on rotation position of the spring control arm, the pawl control spring will be in a first state or position or a in a second state or position, and wherein the activation means comprises a second engagement activation means, when the engagement activation means are activated, the control unit is arranged to control the motor unit of the drive unit to run the motor unit of the drive unit in the second direction, the ratchet housing control arm disengagement cam moving the spring control arms into an engagement mode position, the control unit then being arranged to control the motor unit of the drive unit to run in the second direction until the second, engagement, activation means is deactivated.

12. The arrangement according to claim 11, wherein the ratchet hub, for each ratchet pawl, comprises a rotatably stored spring control arm arranged to control the position or state of the pawl control spring, such that depending on rotation position of the spring control arm, the pawl control spring will be in a first state or position or a in a second state or position, and wherein the activation means comprises a first disengagement activation means, when the first, disengagement means are activated, the control unit is arranged to control the motor unit of the drive unit to run in the first direction until the torque increases, and the ratchet pawls will be locked or engaged in the respective pawl locking seats giving a zero angle position defining a rotation starting position; and with the ratchet pawls locked in the respective pawl locking seats, the control unit will control the motor unit of the drive unit with an increased torque to overcome a bias torque produced by a torque position spring arranged in the ratchet hub between the ingoing shaft socket and the lower hub part, and control the motor unit of the drive unit to make a first number, of revolutions starting from the zero angle in the first direction to rotate the ingoing shaft socket to move the spring control arms into a disengaged mode position, disengaged from the ratchet hub control arm disengagement cam; the control unit then being arranged to control the motor unit of the drive unit to run in the second direction a second, low, number, of revolutions until the ratchet pawls are lifted from the respective pawl locking seats; the control unit then being arranged to control the motor unit of the drive unit to make a third number, of revolutions with a low speed in the first direction to assure correctly performed unlocking or disengagement of the ratchet pawls; and the control unit then being arranged to control the motor unit of the drive unit to run in the first direction until the first disengagement activation means, is deactivated.

13. The arrangement according to claim 12, wherein the activation means comprises a second, engagement, activation means, that when the, engagement, activation means are activated, the control unit is arranged to control the motor unit of the drive unit to run the motor unit of the drive unit in the second direction, the ratchet housing control arm disengagement cam moving the spring control arms into an engagement mode position; the control unit then being arranged to control the motor unit of the drive unit to run in the second direction until the second, engagement, activation means is deactivated.

14. A furling system for a sailing boat, comprising an arrangement as in claim 1.

15. A method comprising using of an arrangement according to claim 1 to furl a mainsail, a headsail a gennaker or a Code 0 sail.

16. The arrangement according to claim 12, wherein the first disengagement activation means comprises, the first number is between three and seven, the second, low, number is between three and seven, the third number is between 30 and 70.

17. The method according to claim 15, wherein the headsail is a jib or a genoa.

* * * * *